US012441570B2

(12) United States Patent
Wang et al.

(10) Patent No.: US 12,441,570 B2
(45) Date of Patent: Oct. 14, 2025

(54) AUTOMATIC DOCUMENT FEEDER

(71) Applicant: Foxlink Image Technology Co., Ltd., New Taipei (TW)

(72) Inventors: Wen Yu Wang, New Taipei (TW); Pai Hsien Su, New Taipei (TW)

(73) Assignee: Foxlink Image Technology Co., Ltd., New Taipei (TW)

( * ) Notice: Subject to any disclaimer, the term of this patent is extended or adjusted under 35 U.S.C. 154(b) by 132 days.

(21) Appl. No.: 18/485,312

(22) Filed: Oct. 12, 2023

(65) Prior Publication Data

US 2024/0158197 A1 May 16, 2024

(30) Foreign Application Priority Data

Nov. 11, 2022 (CN) ..... 202223001415.X

(51) Int. Cl.
*B65H 29/14* (2006.01)
*B65H 5/06* (2006.01)

(52) U.S. Cl.
CPC ..... *B65H 29/14* (2013.01); *B65H 5/062* (2013.01); *B65H 2404/63* (2013.01); *B65H 2404/6942* (2013.01)

(58) Field of Classification Search
CPC ..... B65H 29/14
See application file for complete search history.

(56) References Cited

U.S. PATENT DOCUMENTS

| | | | | |
|---|---|---|---|---|
| 7,237,774 | B2 * | 7/2007 | Fukatsu | B65H 31/3081 270/58.11 |
| 7,431,289 | B2 * | 10/2008 | Sekiyama | B65H 29/70 271/189 |
| 8,087,666 | B2 * | 1/2012 | Honda | B65H 29/14 271/220 |
| 9,170,548 | B2 * | 10/2015 | Takemoto | B65H 29/52 |
| 9,199,817 | B2 * | 12/2015 | Osaki | B65H 31/02 |
| 10,583,672 | B2 * | 3/2020 | Araishi | B41J 11/04 |
| 10,800,630 | B2 * | 10/2020 | Fujiwara | B65H 29/14 |
| 2004/0156032 | A1 * | 8/2004 | Murakami | G03B 27/00 355/41 |
| 2006/0082047 | A1 * | 4/2006 | Fukatsu | G03G 15/6538 271/220 |
| 2006/0237900 | A1 * | 10/2006 | Sekiyama | B65H 29/14 271/220 |
| 2009/0189343 | A1 * | 7/2009 | Hsu | B65H 3/56 271/277 |
| 2010/0171256 | A1 * | 7/2010 | Ogata | G03G 15/6552 271/220 |

* cited by examiner

*Primary Examiner* — Patrick Cicchino

(57) ABSTRACT

An automatic document feeder includes a feeding path, a pickup roller assembly arranged at an upstream of the feeding path for feeding documents into the feeding path, an ejecting tray arranged at a downstream of the feeding path for loading the ejected documents, a paper feeding roller assembly arranged in the feeding path, a paper ejecting roller assembly arranged at the downstream of the feeding path, an anti-drawing arm arranged between the paper ejecting roller assembly and the ejecting tray, and a paper feeding motor. The paper feeding motor drives the pickup roller assembly, the paper feeding roller assembly and the paper ejecting roller assembly.

4 Claims, 12 Drawing Sheets

AUTOMATIC DOCUMENT FEEDER

CROSS-REFERENCE TO RELATED APPLICATION

The present application is based on, and claims priority from, China Patent Application No. 202223001415. X, filed Nov. 11, 2022, the disclosure of which is hereby incorporated by reference herein in its entirety.

BACKGROUND OF THE INVENTION

1. Field of the Invention

The present invention generally relates to an automatic document feeder, and more particularly to an automatic document feeder which is able to avoid fed documents from being drawn back.

2. The Related Art

Referring to FIG. 7 to FIG. 12, in order to improve a document processing efficiency, many office machines are equipped with automatic document feeders which feed documents automatically. A conventional automatic document feeder is shown in FIG. 7. A part of the conventional automatic document feeder has a function of feeding the documents in a reverse direction. The automatic document feeder includes a paper feeding channel 81, an input tray 82 positioned to an upstream of the paper feeding channel 81, an output tray 83 positioned to a downstream of the paper feeding channel 81 for loading the fed documents, a feeding roller assembly 84 positioned to the upstream of the paper feeding channel 81 for feeding the documents into the paper feeding channel 81, a transmission roller assembly 85 positioned in the paper feeding channel 81, an unwinding roller assembly 86 positioned to the downstream of the paper feeding channel 81, and a motor 87 driving the feeding roller assembly 84, the transmission roller assembly 85 and the unwinding roller assembly 86.

Referring to FIG. 7 to FIG. 12, when the motor 87 rotates in a forward direction, the feeding roller assembly 84, the transmission roller assembly 85 and the unwinding roller assembly 86 transmit the documents from the upstream of the paper feeding channel 81 to the downstream of the paper feeding channel 81, and then the documents are fed out to the output tray 83. When the motor 87 rotates in the reverse direction, the feeding roller assembly 84, the transmission roller assembly 85 and the unwinding roller assembly 86 transmit the documents from the downstream of the paper feeding channel 81 to the upstream of the paper feeding channel 81, and the input tray 82 is also restored to an original position.

However, when the motor 87 rotates in the reverse direction, and the motor 87 drives the unwinding roller assembly 86 to rotate in the reverse direction, the documents which are ejected to the output tray 83 might be inadvertently drawn back into the paper feeding channel 81. When the documents which are fed out to the output tray 83 incompletely break away from the unwinding roller assembly 86, so the documents which are in contact with the unwinding roller assembly 86 are easily driven by the unwinding roller assembly 86 to be drawn back into the paper feeding channel 81. Or, when there are too many documents stacked in the output tray 83, the documents stacked on a top of the output tray 83 are easily driven by the unwinding roller assembly 86, and the documents are drawn back into the paper feeding channel 81.

Therefore, it is necessary to provide an automatic document feeder which is able to avoid the fed documents from being drawn back.

SUMMARY OF THE INVENTION

An object of the present invention is to provide an automatic document feeder which is able to avoid fed documents from being drawn back. The automatic document feeder includes a feeding path, a pickup roller assembly arranged at an upstream of the feeding path for feeding the documents into the feeding path, an ejecting tray arranged at a downstream of the feeding path for loading the ejected documents, a paper feeding roller assembly arranged in the feeding path, a paper ejecting roller assembly arranged at the downstream of the feeding path, an anti-drawing arm arranged between the paper ejecting roller assembly and the ejecting tray, and a paper feeding motor. The paper ejecting roller assembly includes a first ejecting roller arranged at a top of the feeding path, and a second ejecting roller arranged at a bottom of the feeding path. The anti-drawing arm includes a pivot section coaxially connected to the first ejecting roller, a stopping section extended downward from the pivot section and extending into the feeding path, and a snapping section extended upward from the pivot section. The paper feeding motor drives the pickup roller assembly, the paper feeding roller assembly and the paper ejecting roller assembly. The snapping section is arranged to contact with a wall of the feeding path when the anti-drawing arm deflects downward by an own weight of the anti-drawing arm.

Another object of the present invention is to provide an automatic document feeder. The automatic document feeder includes a feeding path, a pickup roller assembly arranged at an upstream of the feeding path for feeding documents into the feeding path, an ejecting tray arranged at a downstream of the feeding path for loading the ejected documents, a paper feeding roller assembly arranged in the feeding path, a paper ejecting roller assembly arranged at the downstream of the feeding path, an anti-drawing arm arranged between the paper ejecting roller assembly and the ejecting tray, and a paper feeding motor. The paper ejecting roller assembly includes a first ejecting roller arranged at a top of the feeding path, and a second ejecting roller arranged at a bottom of the feeding path. The anti-drawing arm includes a pivot section coaxially connected to the first ejecting roller, a stopping section extended downward from the pivot section and extending into the feeding path, and a snapping section extended upward from the pivot section. The snapping section is arranged to contact with a wall of the feeding path when the anti-drawing arm deflects downward by an own weight of the anti-drawing arm. A bottom of the stopping section has an end point. The paper feeding motor drives the pickup roller assembly, the paper feeding roller assembly and the paper ejecting roller assembly. A distance between the end point and the pivot section is longer than a radius of the first ejecting roller plus a radius of the second ejecting roller.

Another object of the present invention is to provide an automatic document feeder. The automatic document feeder includes a feeding path, a pickup roller assembly arranged at an upstream of the feeding path for feeding documents into the feeding path, an ejecting tray arranged at a downstream of the feeding path for loading the ejected documents, a paper feeding roller assembly arranged in the feeding path, a paper ejecting roller assembly arranged at the downstream of the feeding path, an anti-drawing arm arranged between the paper ejecting roller assembly and the ejecting tray, and a paper feeding motor. The paper ejecting roller assembly includes a first ejecting roller arranged at a top of the feeding path, and a second ejecting roller arranged at a bottom of the feeding path. The anti-drawing arm includes a pivot section coaxially connected to the first ejecting roller, a stopping section extended downward from the pivot section and extending into the feeding path, and a snapping section extended upward from the pivot section. The snapping section is arranged to contact with a wall of the feeding path when the anti-drawing arm deflects downward by an own weight of the anti-drawing arm. A bottom of the stopping section has an end point. The paper feeding motor drives the pickup roller assembly, the paper feeding roller assembly and the paper ejecting roller assembly. A distance between the pivot section and the end point is greater than a distance between the pivot section and the feeding path.

As described above, the automatic document feeder includes the feeding path, the ejecting tray arranged at the downstream of the feeding path for loading the ejected documents, the paper ejecting roller assembly arranged at the downstream of the feeding path, the anti-drawing arm arranged between the paper ejecting roller assembly and the ejecting tray, and the paper feeding motor drives the paper ejecting roller assembly. Furthermore, the paper ejecting roller assembly includes the first ejecting roller arranged at the top of the feeding path, and the second ejecting roller arranged at the bottom of the feeding path, the anti-drawing arm includes the pivot section coaxially connected to the first ejecting roller, the stopping section extended downward from the pivot section, the stopping section extends downward into the feeding path, and the snapping section extended upward from the pivot section. As a result, the anti-drawing arm blocks the fed documents, so the automatic document feeder is able to avoid the fed documents from being drawn back into the feeding path.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
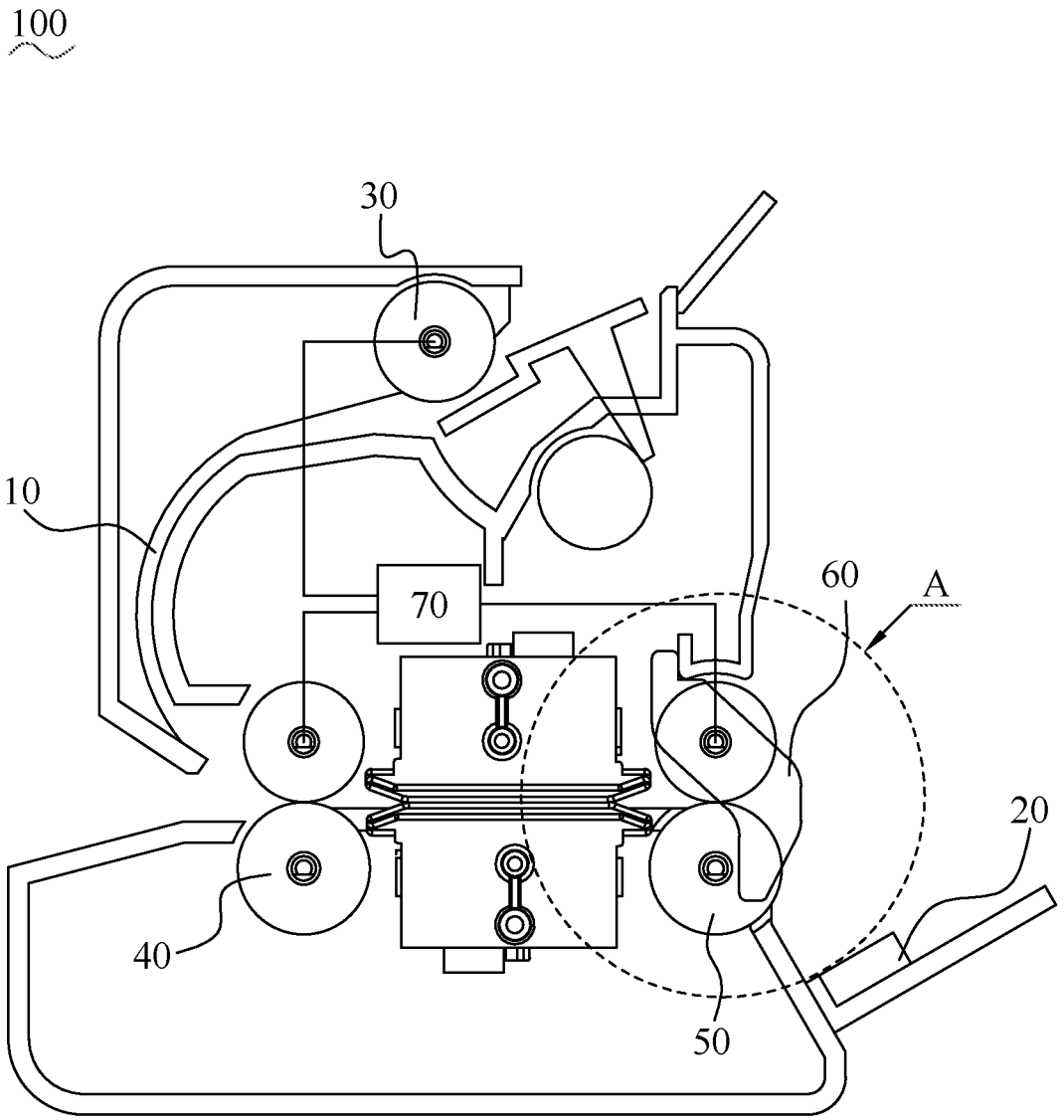
FIG. 1 is a cross-sectional view of an automatic document feeder in accordance with a first preferred embodiment of the present invention.

Referring to FIG. 1, an automatic document feeder 100 in accordance with a first preferred embodiment of the present invention is shown. The automatic document feeder 100 includes a feeding path 10, an ejecting tray 20 arranged at a downstream of the feeding path 10 for loading ejected documents, a pickup roller assembly 30 arranged at an upstream of the feeding path 10 for feeding the documents into the feeding path 10, a paper feeding roller assembly 40 arranged in the feeding path 10, a paper ejecting roller assembly 50 arranged at a downstream of the feeding path 10, an anti-drawing arm 60 arranged between the paper ejecting roller assembly 50 and the ejecting tray 20, and a paper feeding motor 70 driving the pickup roller assembly 30, the paper feeding roller assembly 40 and the paper ejecting roller assembly 50.

Figure 2:
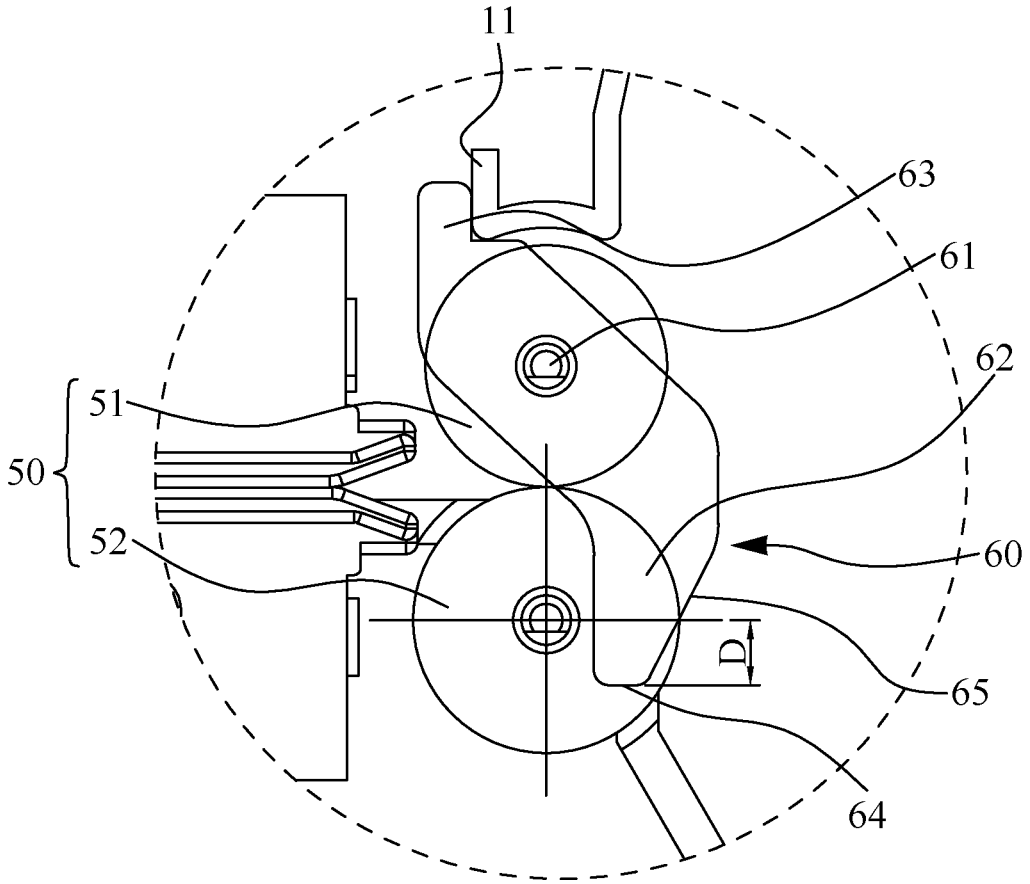
FIG. 2 is an enlarged view of an encircled portion A of the automatic document feeder of FIG. 1.

Referring to FIG. 1 and FIG. 2, in the first preferred embodiment, the paper ejecting roller assembly 50 includes a first ejecting roller 51 arranged at a top of the feeding path 10, and a second ejecting roller 52 arranged at a bottom of the feeding path 10. The anti-drawing arm 60 includes a pivot section 61 pivotally connected to the top of the feeding path 10, a stopping section 62 extended downward from the pivot section 61, and a snapping section 63 extended upward from the pivot section 61. The pivot section 61 is coaxially connected to the first ejecting roller 51. The pivot section 61 is pivotally connected to the first ejecting roller 51. The stopping section 62 extends downward into the feeding path 10, and a bottom of the stopping section 62 has an end point 64. A distance between the end point 64 and the pivot section 61 satisfies a following condition.

The distance between the end point 64 and the pivot section 61 is longer than a radius of the first ejecting roller 51 plus a radius of the second ejecting roller 52.

The distance between the end point 64 and the pivot section 61 is disposed to be longer than the radius of the first ejecting roller 51 plus the radius of the second ejecting roller 52. When the document is driven by the paper ejecting roller assembly 50 to move towards the ejecting tray 20, the stopping section 62 is pushed to flip up, and the document is allowed to pass through the anti-drawing arm 60. After a tail end of the document breaks away the feeding path 10, the stopping section 62 is pulled by an own weight of the stopping section 62 to deflect downward, and the document is pressed downward to be below a quadrant of the second ejecting roller 52, so that the tail end of the document is prevented from hanging to the quadrant of the second ejecting roller 52, and when the paper ejecting roller assembly 50 rotates in the reverse direction, the tail end of the document is drawn back to the feeding path 10.

In the first preferred embodiment, the distance between the end point 64 and the pivot section 61 is equal to a distance sum of the radius of the first ejecting roller 51 and the radius of the second ejecting roller 52 plus a preset distance D. In this first preferred embodiment, the preset distance D is set to 2 mm. Therefore, when the anti-drawing arm 60 is deflected downward by the own weight of the anti-drawing arm 60, the end point 64 is positioned 2 mm below the quadrant of the second ejecting roller 52, so that a contact position between the document and the second ejecting roller 52 is limited to be below a position which is 2 mm below the quadrant of the second ejecting roller 52 so as to ensure that the tail end of the document is without hanging to the second ejecting roller 52.

Figure 3:
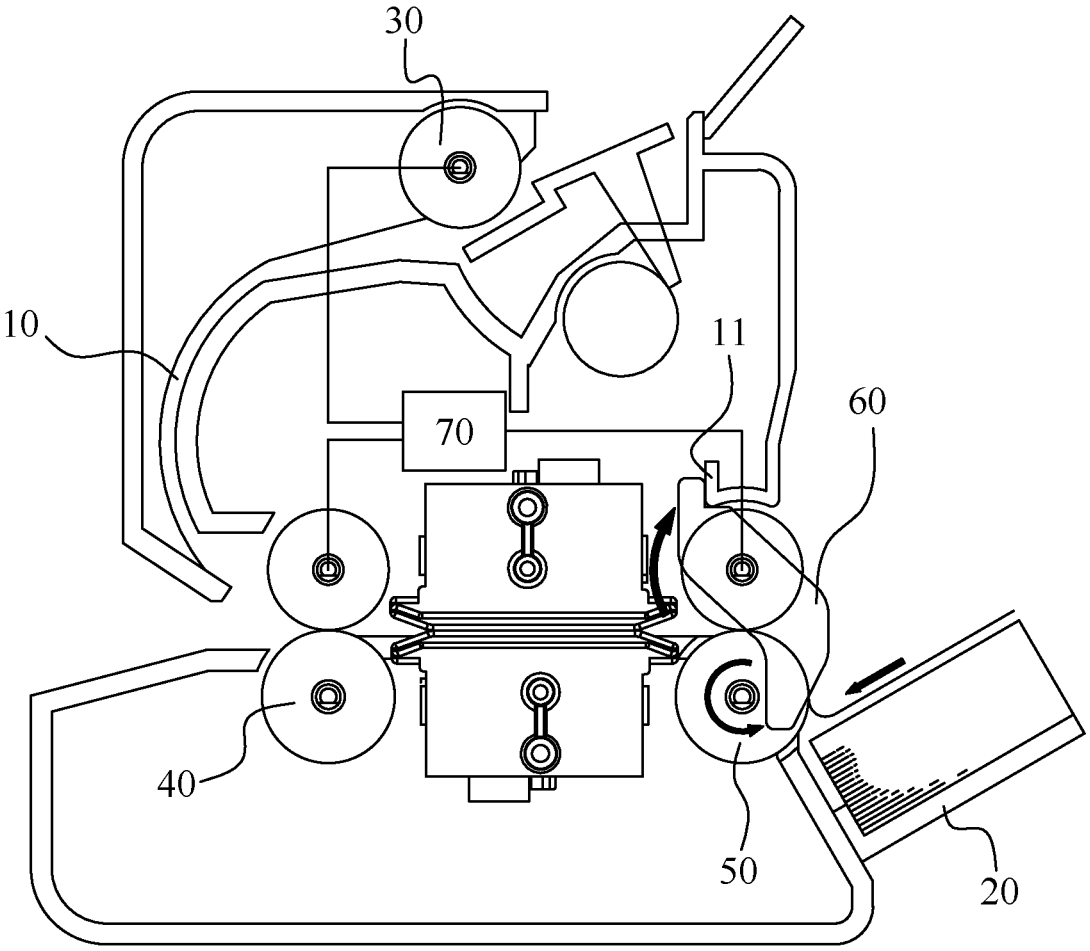
FIG. 3 is a schematic diagram of the automatic document feeder of FIG. 1, wherein an anti-drawing arm of the automatic document feeder prevents a document from being drawn back.

Referring to FIG. 3, one surface of the stopping section 62 is defined as a smooth surface 65 which is positioned adjacent to the downstream of the feeding path 10. The smooth surface 65 satisfies following conditions.

When the anti-drawing arm 60 is deflected downward by the own weight of the anti-drawing arm 60, a lower portion of the smooth surface 65 is lower than the quadrant of the second ejecting roller 52, the lower portion of the smooth surface 65 is accommodated within a peripheral surface of the second ejecting roller 52, an upper portion of the smooth surface 65 is higher than the quadrant of the second ejecting roller 52, and the upper portion of the smooth surface 65 projects beyond the peripheral surface of the second ejecting roller 52. When the document is fed from the downstream of the feeding path 10 towards the upstream of the feeding path 10 to push against the anti-drawing arm 60, the snapping section 63 contacts a wall 11 of the feeding path 10 to prevent the document from being drawn back into the feeding path 10.

Because the lower portion of the smooth surface 65 is lower than the quadrant of the second ejecting roller 52, the lower portion of the smooth surface 65 is accommodated within the peripheral surface of the second ejecting roller 52, the upper portion of the smooth surface 65 is higher than the quadrant of the second ejecting roller 52, and the upper portion of the smooth surface 65 projects beyond the peripheral surface of the second ejecting roller 52, when the document is pressed below the quadrant of the second ejecting roller 52 by the stopping section 62, even though the tail end of the document is rolled up by the second ejecting roller 52, the document will be pushed away from the second ejecting roller 52 by the smooth surface 65 of the anti-drawing arm 60 to avoid the document being drawn back into the feeding path 10.

Referring to FIG. 1 to FIG. 3, the snapping section 63 is arranged to contact with the wall 11 of the feeding path 10 when the anti-drawing arm 60 deflects downward by the own weight of the anti-drawing arm 60, so that the anti-drawing arm 60 is further prevented from rotating downward. When the paper ejecting roller assembly 50 rotates anticlockwise, the paper ejecting roller assembly 50 drives the document that contacts with the paper ejecting roller assembly 50 to move towards the upstream of the feeding path 10. At the moment, the lower portion of the smooth surface 65 is lower than the quadrant of the second ejecting roller 52, the lower portion of the smooth surface 65 is accommodated within the peripheral surface of the second ejecting roller 52, so the document which is fed from the downstream of the feeding path 10 to the upstream of the feeding path 10 contacts with the anti-drawing arm 60, and the document which is fed from the downstream of the feeding path 10 to the upstream of the feeding path 10 further pushes the anti-drawing arm 60 to deflect downward. The anti-drawing arm 60 deflects downward until the snapping section 63 contacts with the wall 11 of the feeding path 10, at the moment, the anti-drawing arm 60 stops deflecting under a combined action of the snapping section 63 and the wall 11 of the feeding path 10, and then the document is further prevented from being drawn back into the feeding path 10 in the reverse direction.

Figure 4:
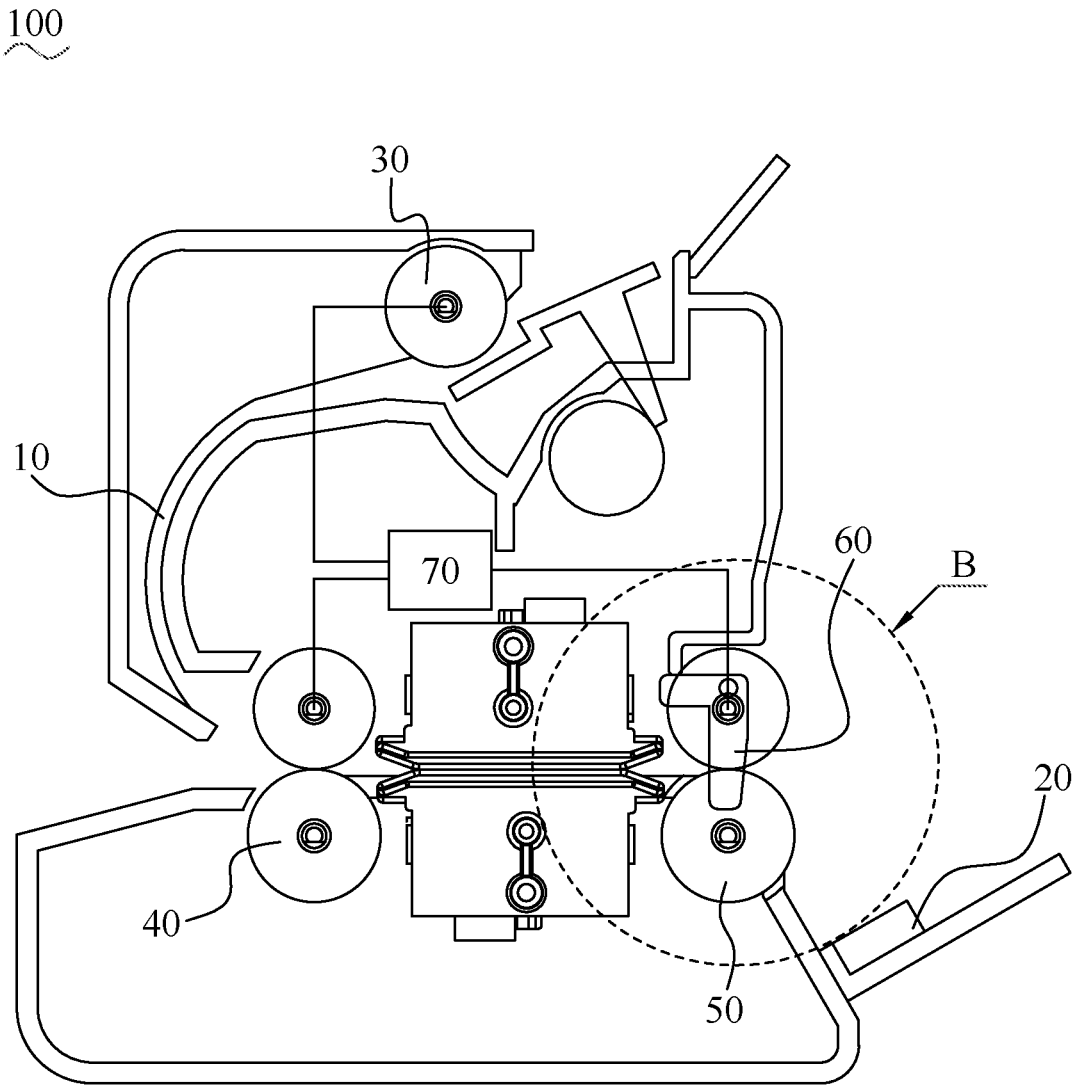
FIG. 4 is a cross-sectional view of the automatic document feeder in accordance with a second preferred embodiment of the present invention.
Figure 5:
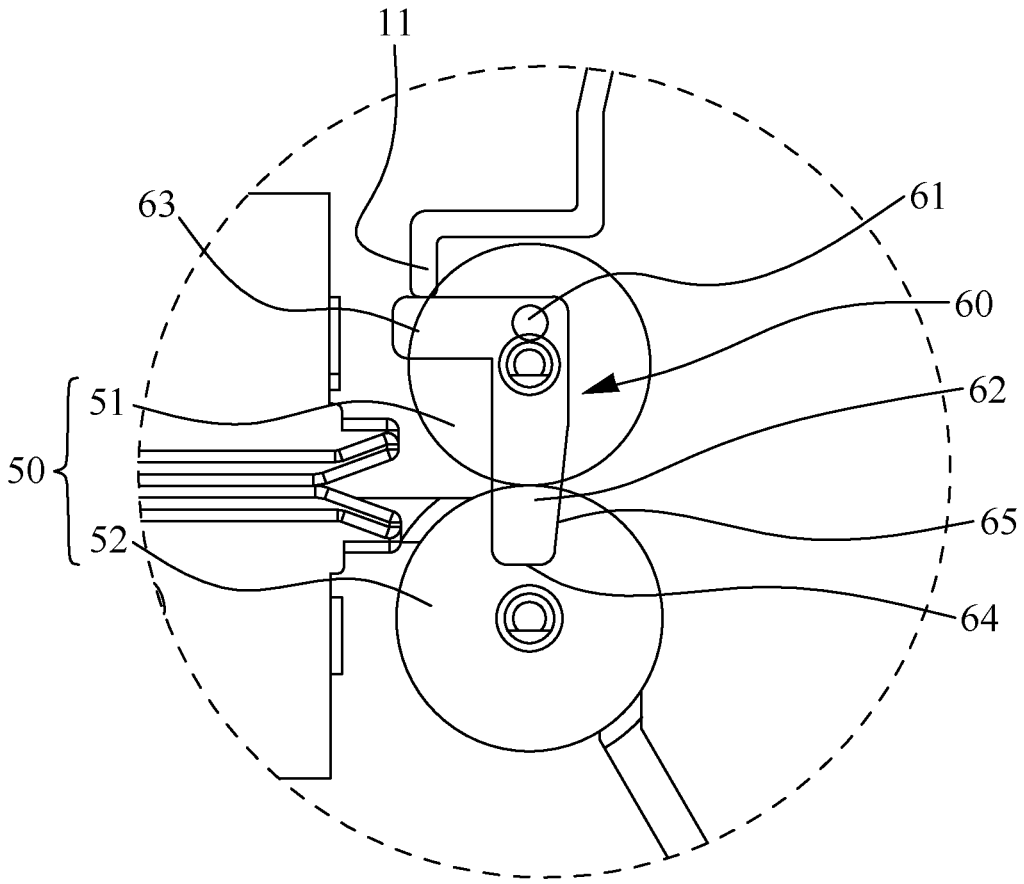
FIG. 5 is an enlarged view of an encircled portion B of the automatic document feeder of FIG. 4.
Figure 6:
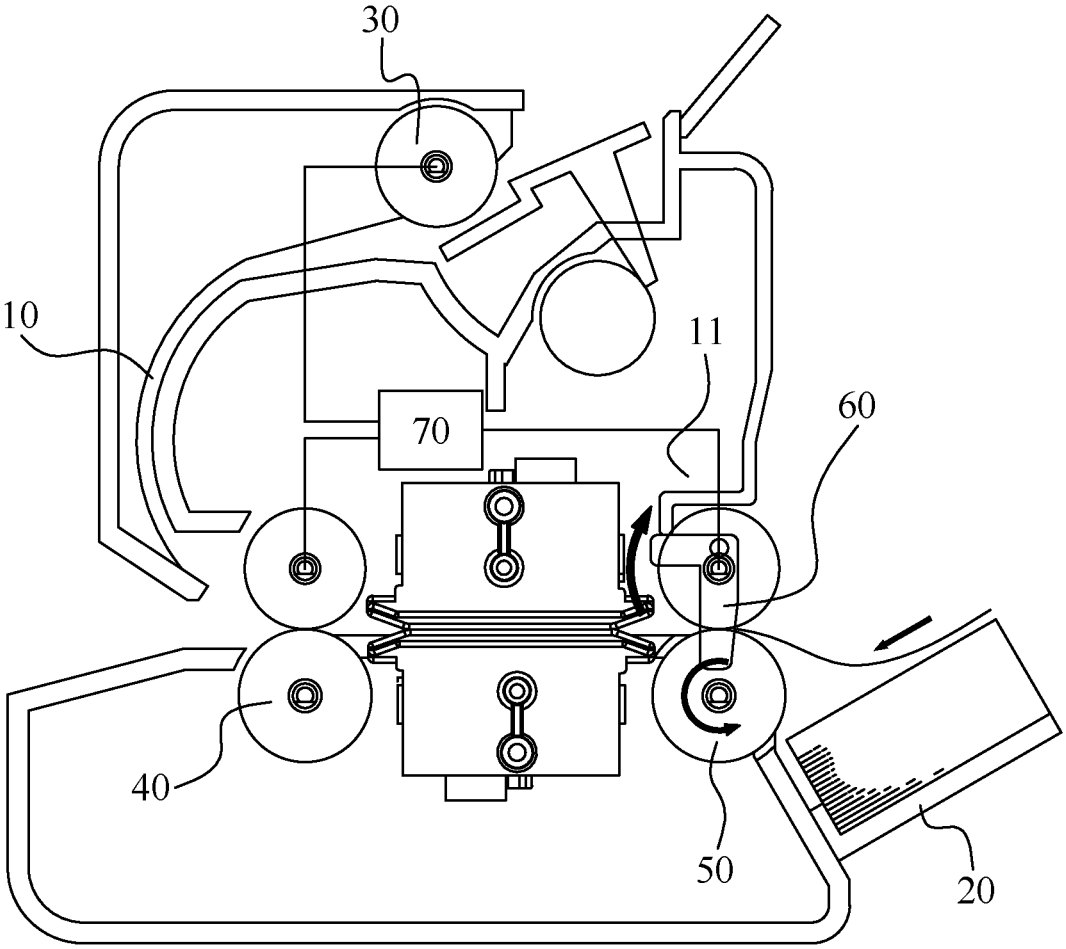
FIG. 6 is a schematic diagram of the automatic document feeder of FIG. 4, wherein the anti-drawing arm of the automatic document feeder prevents the document from being drawn back.
Figure 7:
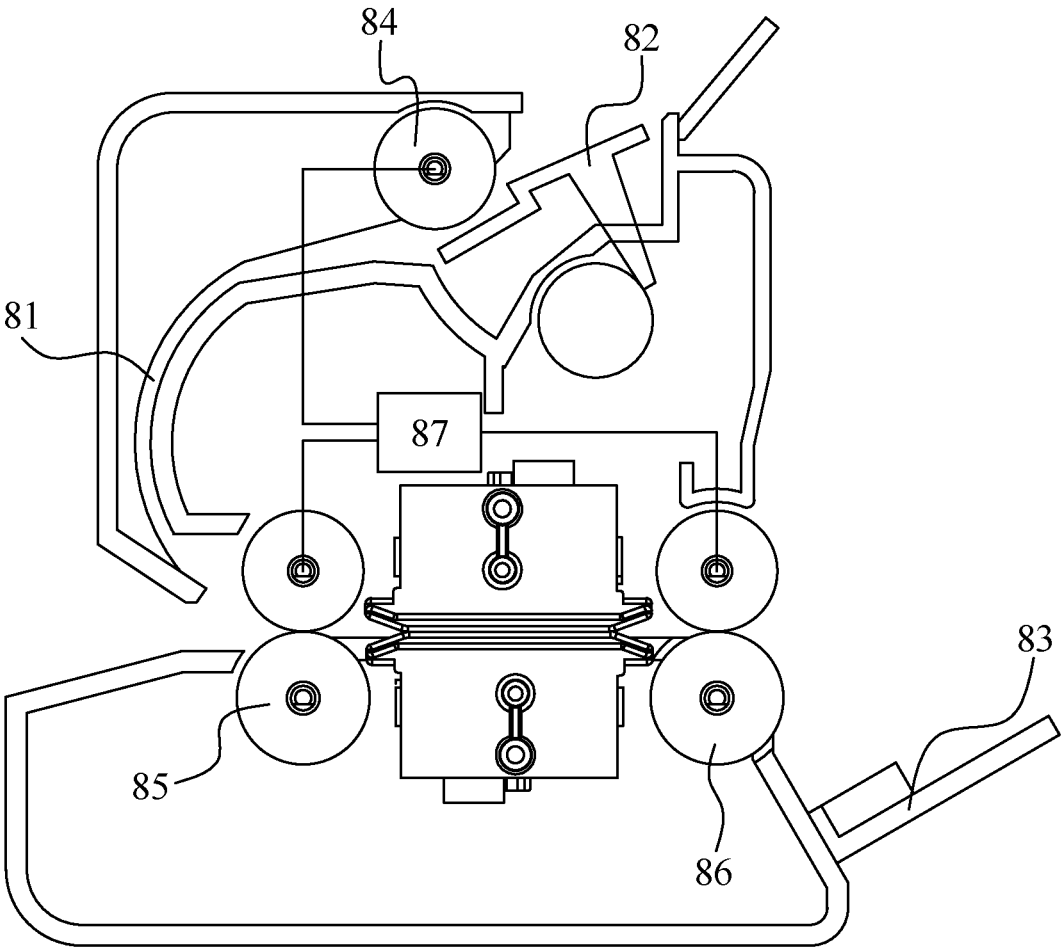
FIG. 7 (Prior Art)
FIG. 7 is a cross-sectional view of a conventional automatic document feeder in prior art.
Figure 8:
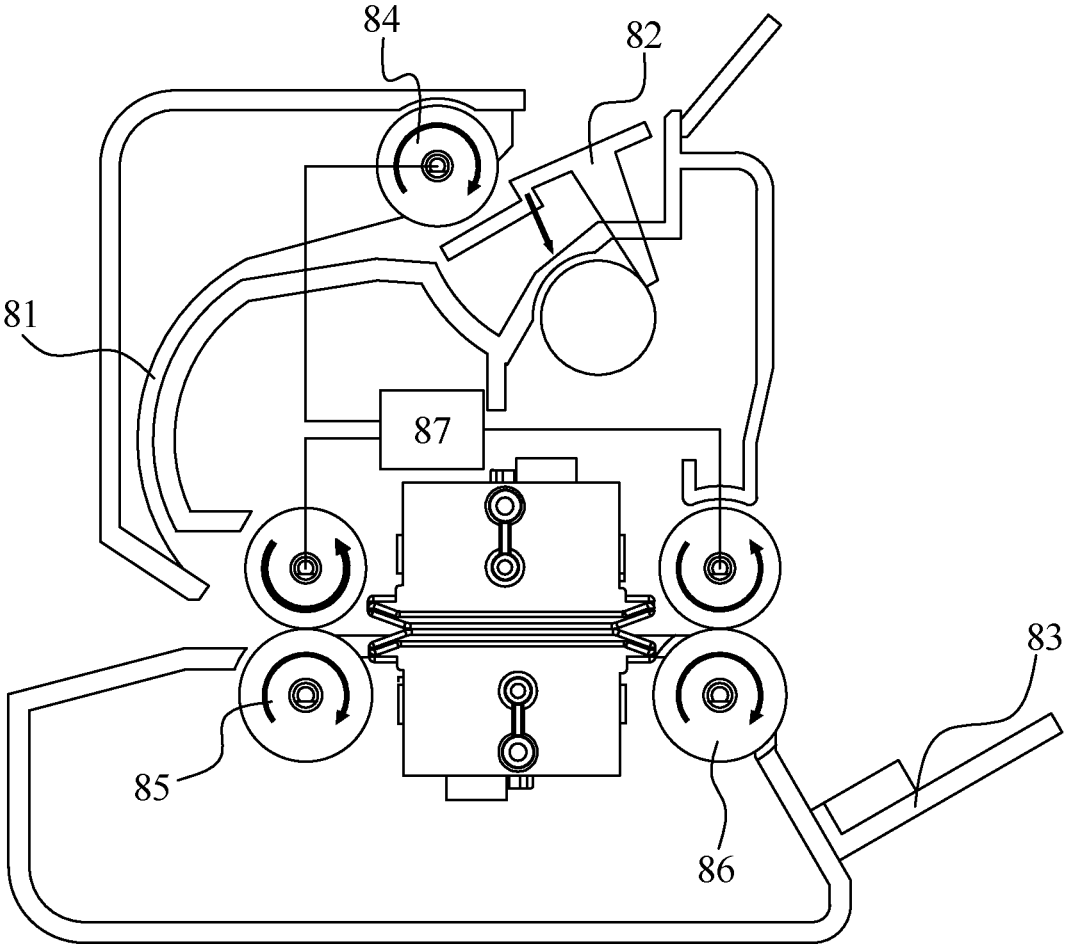
FIG. 8 (Prior Art)
FIG. 8 is a schematic diagram showing that the conventional automatic document feeder feeds a document in a forward direction.
Figure 9:
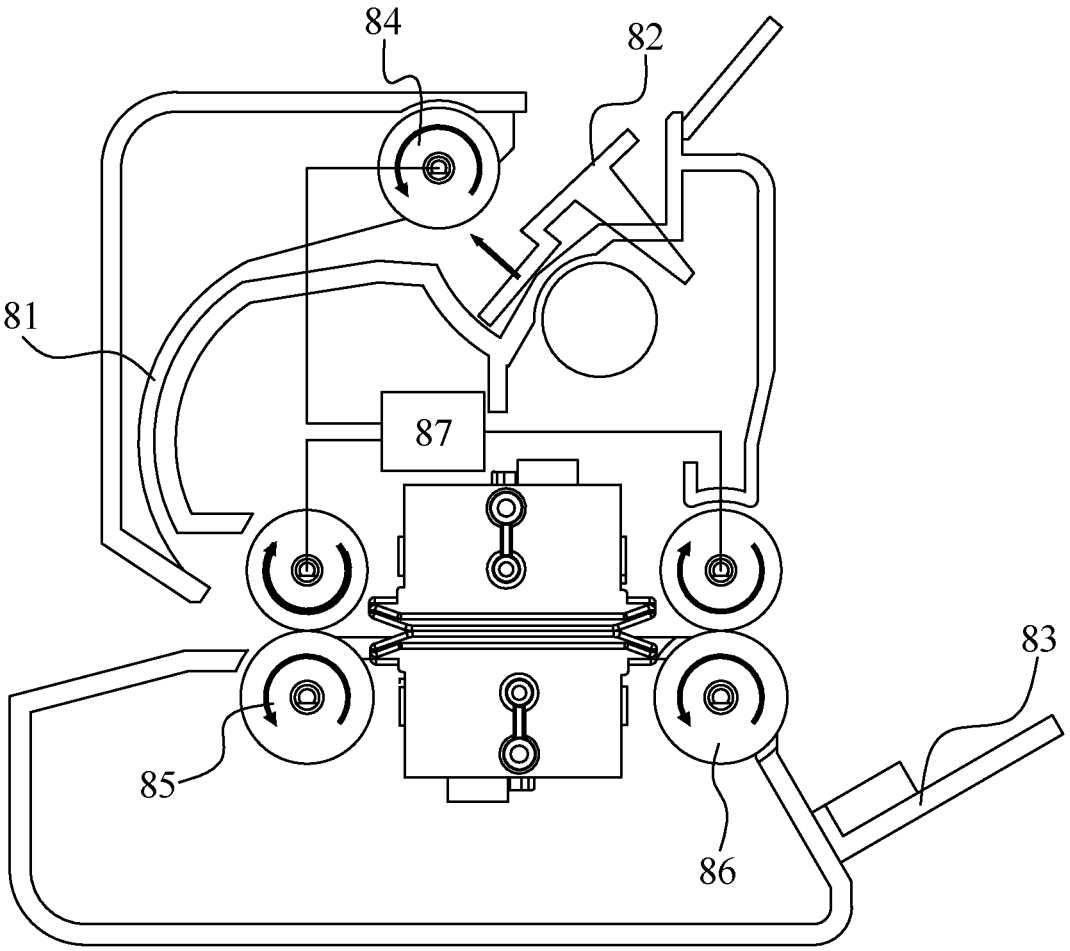
FIG. 9 (Prior Art)
FIG. 9 is a schematic diagram showing that the conventional automatic document feeder feeds the document in a reverse direction.
Figure 10:
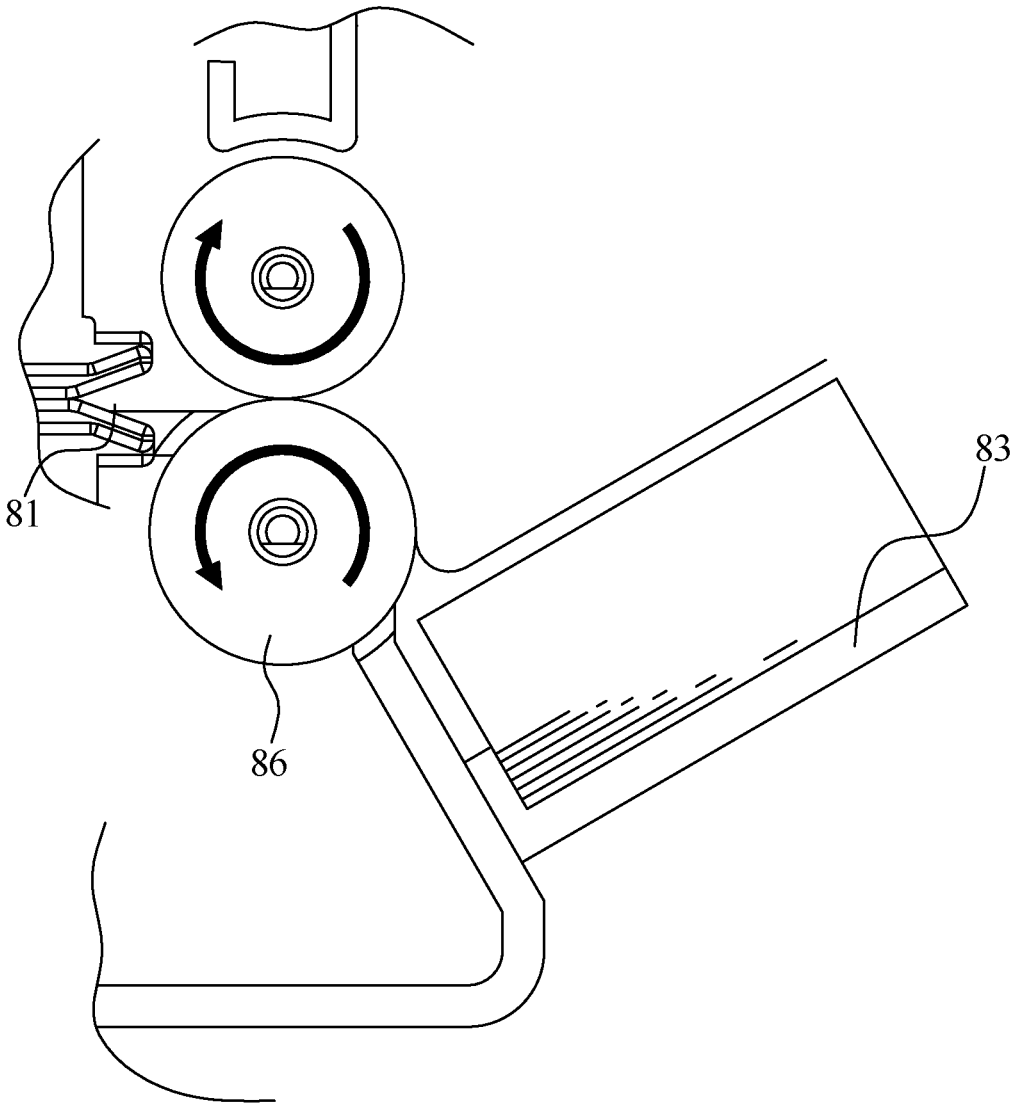
FIG. 10 (Prior Art)
FIG. 10 is a schematic diagram showing that the conventional automatic document feeder draws back the document.
Figure 11:
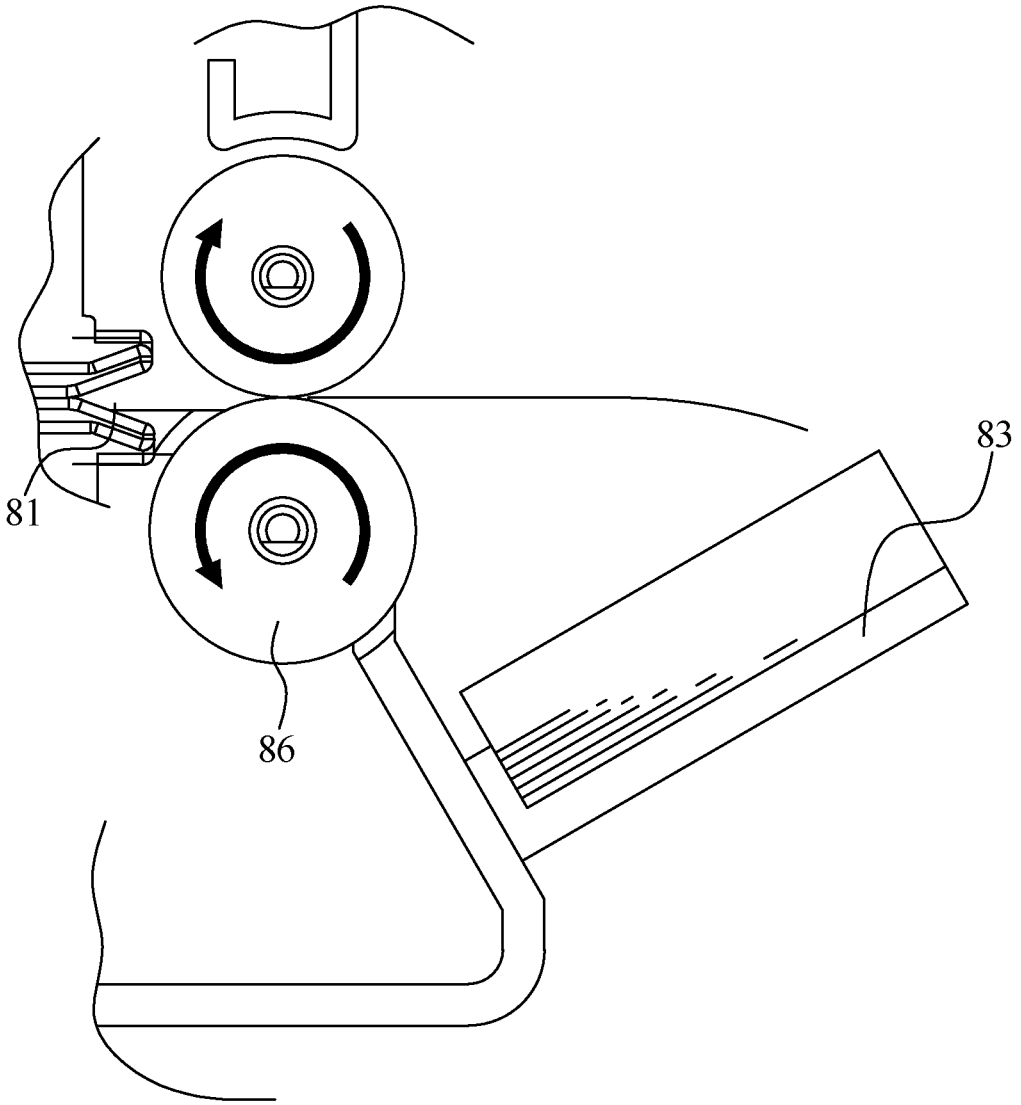
FIG. 11 (Prior Art)
FIG. 11 is another schematic diagram showing that the conventional automatic document feeder draws back the document.
Figure 12:
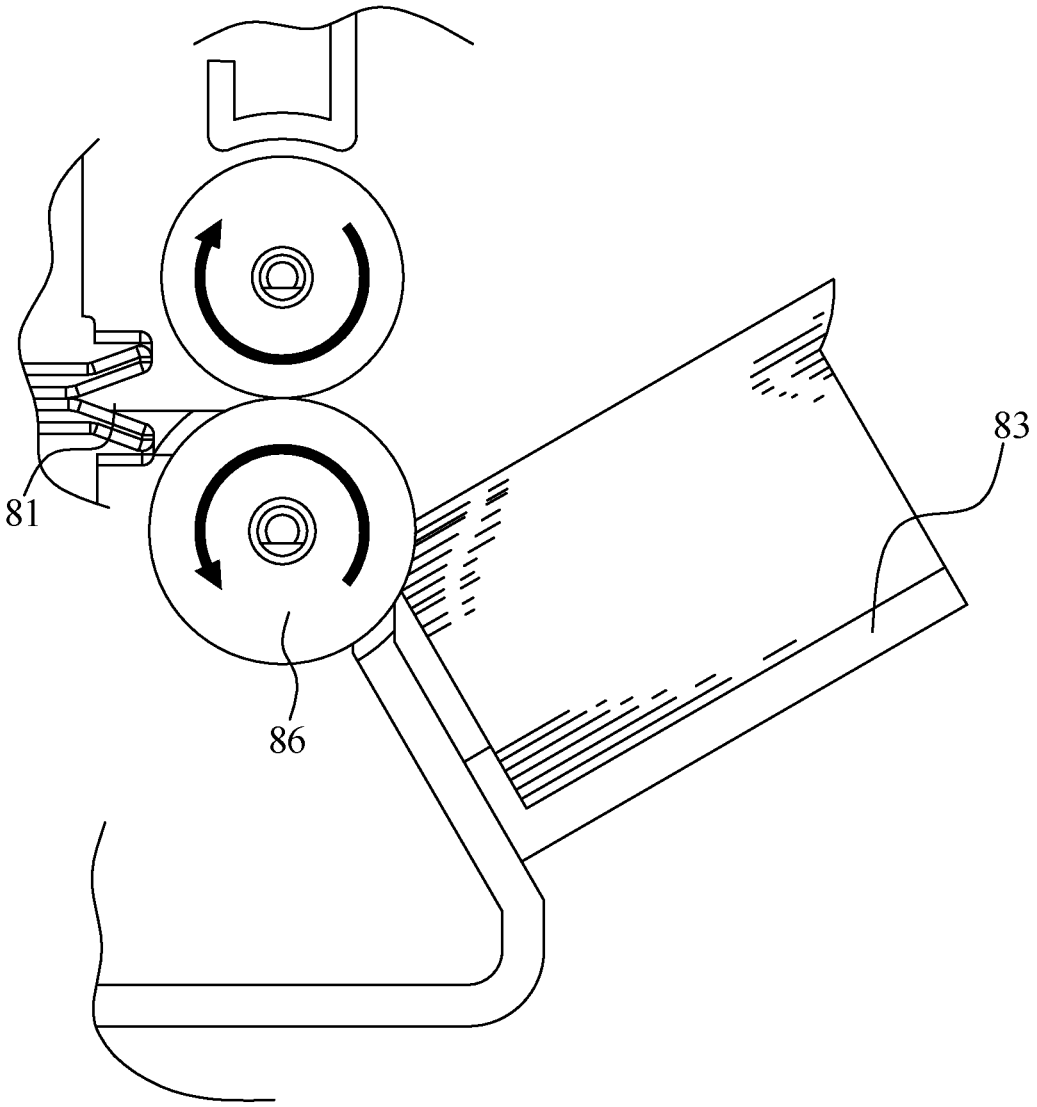
FIG. 12 (Prior Art)
FIG. 12 is one more schematic diagram showing that the conventional automatic document feeder draws back the document.

Referring to FIG. 4 to FIG. 6, the automatic document feeder 100 in accordance with a second preferred embodiment is shown. The distance between the pivot section 61 and the end point 64 is greater than the distance between the pivot section 61 and the feeding path 10. The distance between the end point 64 and the pivot section 61 is set to be greater than the distance between the feeding path 10 and the pivot section 61, so when the document is driven by the paper ejecting roller assembly 50 to move towards the ejecting tray 20, the stopping section 62 is pushed to flip up, and the document is allowed to pass through the anti-drawing arm 60. After the tail end of the document breaks away the feeding path 10, the stopping section 62 is tracked by the own weight to deflect downward, and the document is pressed down to be below the feeding path 10, so that the tail end of the document is prevented from hanging to the second ejecting roller 52 to draw back the document into the feeding path 10 when the paper ejecting roller assembly 50 rotates in the reverse direction.

In this second preferred embodiment, the smooth surface 65 satisfies following conditions: when the anti-drawing arm 60 is deflected downward by the own weight of the anti-drawing arm 60, a position of the end point 64 falls within the peripheral surface of the second ejecting roller 52, the smooth surface 65 is located at a downstream of a contact point between the first ejecting roller 51 and the second ejecting roller 52, and the smooth surface 65 covers a position of the feeding path 10.

The end point 64 falls within the peripheral surface of the second ejecting roller 52, the smooth surface 65 is located at the downstream of the contact point between the first ejecting roller 51 and the second ejecting roller 52, and the smooth surface 65 covers the position of the feeding path 10, so when the document is fed away from the contact point between the first ejecting roller 51 and the second ejecting roller 52, even though the tail end of the document is rolled up by the second ejecting roller 52, the tail end of the document will be blocked by the smooth surface 65 to the downstream of the contact point of the first ejecting roller 51 and the second ejecting roller 52.

In this second preferred embodiment, the snapping section 63 laterally extends outward from the pivot section 61. When the paper ejecting roller assembly 50 rotates in the reverse direction, the document is driven to move towards an upstream direction of the feeding path 10, at the moment, the document is blocked outside of the contact point of the first ejecting roller 51 and the second ejecting roller 52 by the smooth surface 65, so the document further pushes the anti-drawing arm 60 to deflect downward until the snapping section 63 contacts with the wall 11 of the feeding path 10 for preventing the document from being fed backward into the feeding path 10 in the reverse direction.

As described above, the automatic document feeder 100 includes the feeding path 10, the ejecting tray 20 arranged at the downstream of the feeding path 10 for loading the ejected documents, the paper ejecting roller assembly 50 arranged at the downstream of the feeding path 10, the anti-drawing arm 60 arranged between the paper ejecting roller assembly 50 and the ejecting tray 20, and the paper feeding motor 70 drives the paper ejecting roller assembly 50. Furthermore, the paper ejecting roller assembly 50 includes the first ejecting roller 51 arranged at the top of the feeding path 10, and the second ejecting roller 52 arranged at the bottom of the feeding path 10, the anti-drawing arm 60 includes the pivot section 61 coaxially connected to the first ejecting roller 51, the stopping section 62 extended downward from the pivot section 61, the stopping section 62 extends downward into the feeding path 10, and the snapping section 63 extended upward from the pivot section 61. As a result, the anti-drawing arm 60 blocks the fed documents, so the automatic document feeder 100 is able to avoid the fed documents from being drawn back into the feeding path 10.

What is claimed is:

1. An automatic document feeder, comprising:

a feeding path;

a pickup roller assembly arranged at an upstream of the feeding path for feeding documents into the feeding path;

an ejecting tray arranged at a downstream of the feeding path for loading ejected documents;

a paper feeding roller assembly arranged in the feeding path;

a paper ejecting roller assembly arranged at the downstream of the feeding path, the paper ejecting roller assembly including a first ejecting roller arranged at a top of the feeding path, and a second ejecting roller arranged at a bottom of the feeding path;

an anti-drawing arm arranged between the paper ejecting roller assembly and the ejecting tray, the anti-drawing arm including a pivot section coaxially connected to the first ejecting roller, a stopping section extended downward from the pivot section and extending into the feeding path, and a snapping section extended upward from the pivot section; and a paper feeding motor driving the pickup roller assembly, the paper feeding roller assembly and the paper ejecting roller assembly, wherein the snapping section is arranged to contact with a wall of the feeding path when the anti-drawing arm deflects downward by an own weight of the anti-drawing arm, one surface of the stopping section is defined as a smooth surface which is positioned adjacent to the downstream of the feeding path, a bottom of the stopping section has an end point, when the anti-drawing arm is deflected downward by the own weight of the anti-drawing arm, a position of the end point falls within a peripheral surface of the second ejecting roller, the smooth surface is located at a downstream of a contact point between the first ejecting roller and the second ejecting roller, and the smooth surface covers a position of the feeding path.

2. The automatic document feeder as claimed in claim 1, wherein a distance between the end point and the pivot section satisfies a following condition: the distance between the pivot section and the end point is greater than a distance between the pivot section and the feeding path.

3. The automatic document feeder as claimed in claim 1, wherein when the document is fed from the downstream of the feeding path towards the upstream of the feeding path to push against the anti-drawing arm, the snapping section contacts the wall of the feeding path to prevent the document from being drawn back into the feeding path.

4. An automatic document feeder, comprising:

a feeding path;

a pickup roller assembly arranged at an upstream of the feeding path for feeding documents into the feeding path;

an ejecting tray arranged at a downstream of the feeding path for loading the ejected documents;

a paper feeding roller assembly arranged in the feeding path;

a paper ejecting roller assembly arranged at the downstream of the feeding path, the paper ejecting roller assembly including a first ejecting roller arranged at a top of the feeding path, and a second ejecting roller arranged at a bottom of the feeding path;

an anti-drawing arm arranged between the paper ejecting roller assembly and the ejecting tray, the anti-drawing arm including a pivot section coaxially connected to the first ejecting roller, a stopping section extended downward from the pivot section and extending into the feeding path, and a snapping section extended upward from the pivot section, the snapping section being arranged to contact with a wall of the feeding path when the anti-drawing arm deflects downward by an own weight of the anti-drawing arm, a bottom of the stopping section having an end point; and a paper feeding motor driving the pickup roller assembly, the paper feeding roller assembly and the paper ejecting roller assembly, wherein a distance between the pivot section and the end point is greater than a distance between the pivot section and the feeding path, one surface of the stopping section is defined as a smooth surface which is positioned adjacent to the downstream of the feeding path, when the anti-drawing arm is deflected downward by the own weight of the anti-drawing arm, a position of the end point falls within a peripheral surface of the second ejecting roller, the smooth surface is located at a downstream of a contact point between the first ejecting roller and the second ejecting roller, and the smooth surface covers a position of the feeding path.

* * * * *